US005494419A

United States Patent [19]

Lin

[11] Patent Number: 5,494,419

[45] Date of Patent: Feb. 27, 1996

[54] PORTABLE AND FLEXIBLE AIR PUMP FOR BICYCLE

[75] Inventor: Chi-So Lin, Taichung, Taiwan

[73] Assignee: Shu-Mu Wu, Taichung, Taiwan

[21] Appl. No.: 326,232

[22] Filed: Oct. 20, 1994

[51] Int. Cl.[6] ..... F04B 53/16

[52] U.S. Cl. ..... 417/437; 285/235

[58] Field of Search ..... 417/437, 572, 417/544; 92/58.1; 285/235, 355

[56] References Cited

U.S. PATENT DOCUMENTS

| | | | |
|---|---|---|---|
| 164,816 | 6/1875 | Dayton | 285/255 |
| 564,736 | 7/1896 | Braun | 92/58.1 |
| 695,199 | 3/1902 | Eddy | 92/58.1 |
| 1,625,097 | 4/1927 | Rudolph | 92/58.1 |
| 4,314,717 | 2/1982 | Bjurman | 285/235 |

FOREIGN PATENT DOCUMENTS

| | | | |
|---|---|---|---|
| 0615417 | 2/1961 | Canada | 92/58.1 |

*Primary Examiner*—Richard A. Bertsch
*Assistant Examiner*—Roland G. McAndrews, Jr.
*Attorney, Agent, or Firm*—Browdy and Neimark

[57] ABSTRACT

A portable flexible air pump comprises a connection head, a main body and a flexible body located between the connection head and the main body. The connection head is provided therein with an air duct and is engageable with the air valve of a bicycle tire. The main body is provided therein with an air channel in communication with the air duct of the connection head. The air channel is intended to transmit the compressed air. The flexible body is provided axially with a passageway and is connected at both ends thereof with the connection head and the main body by two pivoting members. The air duct of the connection head is in communication with the air channel of the main body via the passageway of the flexible body. The connecting portion between the flexible body and the connection head and the connecting portion between the flexible body and the main body are made airtight by two leakproof portions. The connection head of the air pump can be therefore maneuvered at any angle to facilitate the pumping of air, thanks to the flexible body.

3 Claims, 2 Drawing Sheets

PORTABLE AND FLEXIBLE AIR PUMP FOR BICYCLE

FIELD OF THE INVENTION

The present invention relates generally to an air pump, and more particularly to a portable air pump which is built in harmony with the engineering of human body to facilitate the pumping of air into a bicycle tire.

BACKGROUND OF THE INVENTION

The conventional portable bicycle air pumps are shown in FIGS. 1 and 2. Such air pumps are detachably fastened to the bicycle frame. As shown in FIG. 1, a conventional one-stroke air pump 10 comprises a connection head 12 having a rear side which is fastened integrally with a cylinder 13. The act of pumping is brought about by a handle 14 which is pushed inwards to cause the piston to compress the air inside the cylinder 13. As illustrated in FIG. 2, a conventional two-stroke air pump 11 comprises a connection head 15 having a handle 16 which is attached to the rear side thereof. As a cylinder 17 is pushed and pulled, the piston is caused to compress the air in the cylinder 17. Such prior art air pumps 10 and 11 as described above are defective in design in that they are rigid and inflexible, and that they can not be therefore operated easily at any angle by a user.

SUMMARY OF THE INVENTION

It is therefore the primary objective of the present invention to provide a portable and flexible air pump which is built in harmony with the engineering of human body to facilitate the pumping of air into a bicycle tire.

The foregoing objective of the present invention is attained by an air pump which comprises mainly a connection head and a main body. The connection head is provided therein with an air duct and is engageable with the air valve of a bicycle tire. The main body is provided with an air channel in communication with the air duct of the connection head. The air channel is intended to transmit the compressed air. The air pump of the present invention is characterized in that it further comprises a flexible body, two annular threaded members, and two leakproof portions. The flexible body is provided axially with a passageway and is connected at both ends thereof with the connection head and the main body by means of the two annular threaded members. The air duct of the connection head is in communication with the air channel of the main body via the passageway of the flexible body. The connecting portion between the flexible body and the connection head and the connecting portion between the flexible body and the main body are made airtight by means of the two leakproof portions. The connection head of the air pump of the present invention can be therefore maneuvered at any angle to facilitate the pumping of air, thanks to the flexible body.

DETAILED DESCRIPTION OF THE INVENTION

Figure 1:
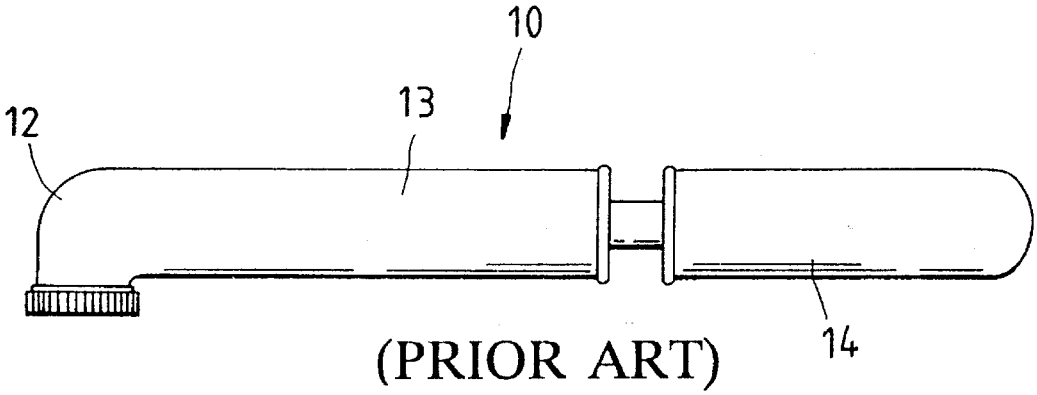
(PRIOR ART) FIG. 1
FIGS. 1 and 2 show schematic views of the conventional portable air pumps in action.
Figure 2:
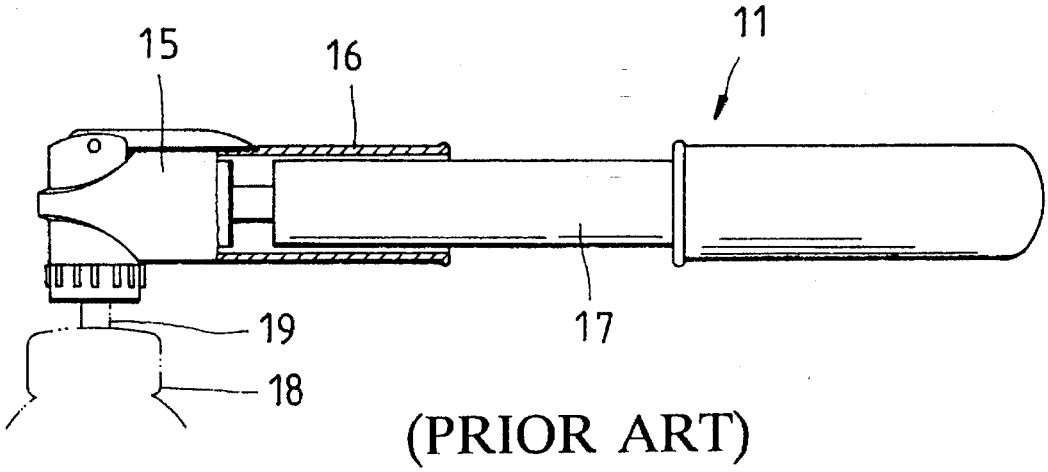
(PRIOR ART) FIG. 2
Figure 3:
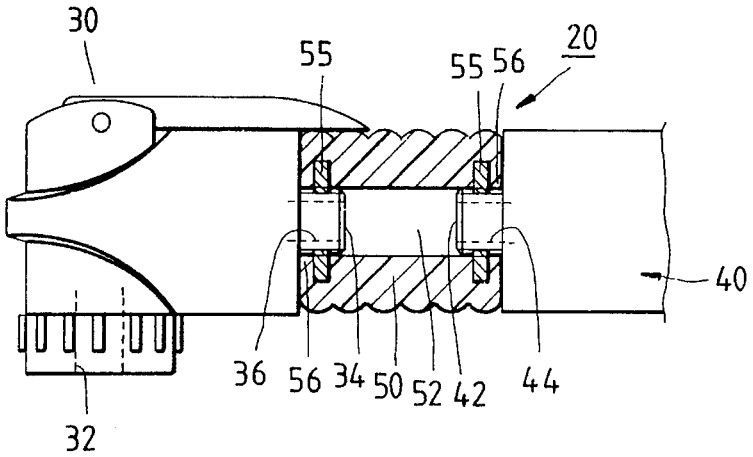
FIG. 3 shows a sectional schematic view of a preferred embodiment of the present invention.

As shown in FIG. 3, a portable flexible one-stroke or two-stroke air pump 20 of the present invention comprises the component parts described hereinafter.

A connection head 30 is provided therein with an air valve connection device, which is not shown in the drawing. The connection head 30 is provided at the bottom thereof with a fitting hole 32 in communication with the air valve connection device. The connection head 30 is further provided at one side thereof with a an extended portion 34 which is provided with an air duct 36 communicating with the air valve connection device. The fitting hole 32 of the connection head 30 is fitted over the inflation valve of a bicycle tire so as to cause the inflation valve to become connected with the air valve device.

A pumping cylinder main body 40 is different in definition from the connection head 30. The main body 40 forms the external structural members of the air pump, such as the cylinder, and can be a portion of the cylinder or another structural member. The main body 40 is provided at one end thereof with an extended portion 42 which is in turn provided with an air channel 44 in communication with the interior of the air pump cylinder for transporting the air which is compressed by the piston.

A flexible body 50 of a soft material is provided with an appropriate rigidity and is similar in outer diameter with the main body 40. The flexible body 50 is provided axially with a passageway 52 and is further provided respectively in both ends thereof with an annular threaded member 55. Located between the pivoting member 55 and the flexible body is a leakproof portion 56.

The air pump 20 of the present invention further comprises a piston, a piston rod, etc., which are not the subject matters of the present invention and will not be therefore described here.

In combination, the connection head 30 is fastened with one end of the flexible body 50 such that the extended portion 34 is fastened with the annular member 55 of the flexible body 50. The connection head 30 and the extended member 55 are connected in an airtight manner by means of the leakproof portion 56. The main body 40 is fastened with another end of the flexible body 50 such that the extended portion 42 of the main body 42 is fastened with another annular member 55 of the flexible body 50. The main body 40 and the annular member 55 are connected in an airtight manner by means of a leakproof portion 56. The passageway 52 of the flexible body 50 is in communication with the air duct 36 of the connection head 30 and the air channel 44 of the main body 40.

Figure 4:
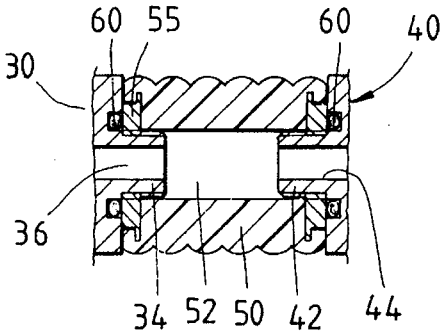
FIG. 4 shows a sectional schematic view of a second embodiment in action according to the present invention.

As shown in FIG. 4, a second preferred embodiment of the present invention is different from the first preferred embodiment of the present invention in that the two annular threaded members 55 are embedded respectively in both ends of the flexible body 50 in such a way that an outer side surfaces of the annular members 55 and an end surface of the flexible body 50 are respectively aligned. In addition, the second preferred embodiment of the present invention comprises two leakproof rings 60 in place of the leakproof portions 56 of the first preferred embodiment of the present invention. The leakproof rings 60 are located respectively between the flexible body 50 and the connection head 30 and between the flexible body 50 and the main body 40.

Figure 5:
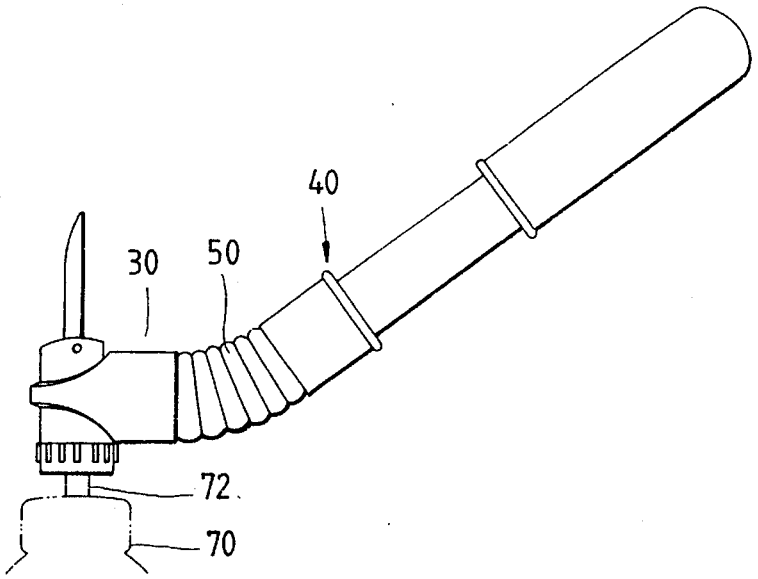
FIG. 5 shows a schematic view of the operational conditions of the present invention.

The operation of the air pump of the present invention is illustrated in FIG. 5. The connection head 30 is connected with the inflation valve 72 of the tire 70. The air pump 20 is exerted upon by an external force. The compressed air is caused to enter the passageway 52 of the flexible body 50 via the air channel 44 of the main body 40 before the compressed air is injected into the tire via the air duct 36 of the connection head 30.

The present invention is inherently superior to the prior art. As shown in FIG. 5, the connection head 30 is connected with the inflation valve 72 of the tire 70 such that the connection head 30 and the main body 40 form a predetermined angle, thanks to the flexibility of the flexible body 50. The angle formed by the connection head 30 and the main body 40 can be so adjusted at will by the user as to facilitate the pumping of air. The flexible body 50 is provided with an appropriate rigidity enabling the connection head 30 to remain in alignment with the main body 40.

The embodiments of the present invention described above are to be regarded in all respects as merely illustrative and not restrictive. Accordingly, the present invention may be embodied in other specific forms without deviating from the spirit thereof. For example, the pivoting members 55 may be of various forms. The present invention is therefore to be limited only by the scope of the following appended claims.

What is claimed is:

1. A portable flexible air pump comprising:

a connection head provided therein with an air duct and engageable with an inflation valve of a tire; and a cylindrical main body provided therein with an air channel for transporting compressed air, said air channel being in communication with said connection head;

wherein a flexible body is located between said connection head and said main body and is provided with a passageway, said flexible body having an annular threaded member fixedly embedded at each end thereof, each said annular threaded member being respectively threadedly engaged to said main body and said connection head such that said passageway of said flexible body is in communication with said air duct of said connection head and said air channel of said main body, each said annular threaded member being connected respectively with said connection head and said main body in an airtight manner by means of a leakproof element therebetween, wherein said connection head, said main body and said flexible body are coaxially arranged when said air pump is not in use.

2. The portable flexible air pump of claim 1 wherein each said annular threaded member is fastened to the end surface of said flexible body such that the end surface and each said annular threaded member form therebetween a portion having a predetermined thickness forming said leakproof element.

3. The portable flexible air pump of claim 1 wherein said leakproof portion is a leakproof ring.

* * * * *